United States Patent [19]

Ermert et al.

[11] Patent Number: 4,898,096

[45] Date of Patent: Feb. 6, 1990

[54] SAFETY DEVICE FOR FIRING CIRCUITS

[75] Inventors: Klaus Ermert, Munich; Horst Hütter, Tegernsee, both of Fed. Rep. of Germany

[73] Assignee: Messerschmitt-Bölkow-Blohm GmbH, Munich, Fed. Rep. of Germany

[21] Appl. No.: 336,705

[22] Filed: Apr. 12, 1989

[30] Foreign Application Priority Data

Jul. 13, 1988 [DE] Fed. Rep. of Germany ..... 3823627

[51] Int. Cl.[4] ..... F42C 15/00; F42C 15/18

[52] U.S. Cl. ..... 102/221; 102/254

[58] Field of Search ..... 102/221, 222, 254, 255, 102/256, 229, 244, 259

[56] References Cited

U.S. PATENT DOCUMENTS

| | | | |
|---|---|---|---|
| 2,666,388 | 1/1954 | Wheeler | 102/254 |
| 3,618,527 | 11/1971 | Kilmer | 102/254 |
| 4,407,201 | 10/1983 | Jensen | 102/256 |
| 4,483,250 | 11/1984 | Thurston et al. | 102/254 |
| 4,691,635 | 9/1987 | Winterhalter et al. | 102/254 |

*Primary Examiner*—David H. Brown

*Attorney, Agent, or Firm*—Kenyon & Kenyon

[57] ABSTRACT

An improved shaft for a munition firing apparatus is disclosed. The shaft has a multiplicity of approximately curved firing channels and is supported in the firing apparatus in a low friction manner.

1 Claim, 1 Drawing Sheet

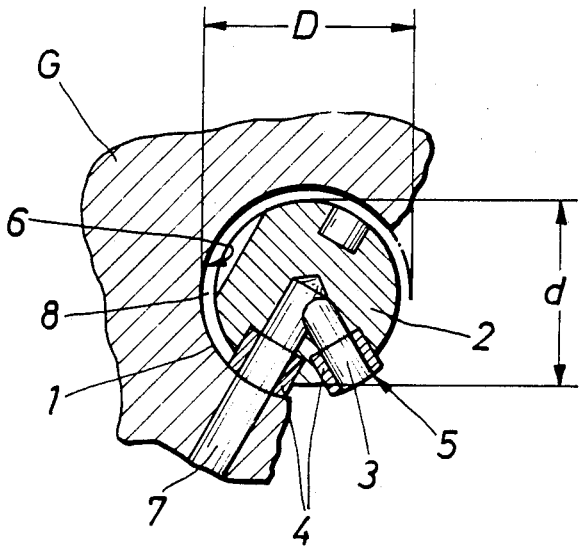
D
G
6
8
1
7
4
3
5
2
d

SAFETY DEVICE FOR FIRING CIRCUITS

FIELD OF THE INVENTION

The present invention relates to the field of safety devices for arming and firing munitions. More specifically, it relates to a safety device with a shaft, the shaft being rotatably supported in a bore through a housing and having a multiplicity of approximately curved firing channels which, in the armed position, correspond with openings in the wall of the bore.

BACKGROUND OF THE INVENTION

Safety devices for firing circuits are known. The device shown in German Patent No. 3,503,013 serves to trigger a multiplicity of munitions which can be fired in the same manner from the same housing, either individually, with any desired time interval between successive firings, or simultaneously. To this end, the shaft must be turned repeatedly from the safety position to the armed position and back.

This device becomes clogged with combustion products which are formed by the munitions after only one firing operation, making further rotation of the shaft impossible with the available power from the drive motor.

It is an object of this invention to design a safety device which will allow reliable rotation of the shaft from the safety to the armed position and back even after several firing operations.

SUMMARY OF THE INVENTION

This object and others are fulfilled by the present invention wherein the diameter of the firing shaft is smaller than the inside diameter of the housing bore and the firing channels have annular overextending boundaries, the radially curved outside surfaces of which rest against the inside wall of the housing bore.

The particular advantage of this safety device is that there is only a small contact area between the outside surfaces of the boundaries and the inside wall. This reduces the friction between the shaft and the housing to a minimum and the edges of the boundary have a self-cleaning effect when the shaft is turned.

These and other objects and advantages of the invention will appear more clearly from the following specification in connection with the accompanying drawing, in which:

BRIEF DESCRIPTION OF THE DRAWING

The FIGURE is a section of the present invention.

DETAILED DESCRIPTION

The sole FIGURE shows in a schematically simplified fashion a section through shaft 2 and firing channel 3. The shaft is supported in housing G by means of bearings (not shown) and can rotate. A motor can be used to drive the shaft. Shaft 2 has a plurality of firing channels which are approximately curved by an angle of about 60° to 90°. In the illustrated "armed" position, firing channel 3 corresponds with opening 7 in housing G, through which the combustion products of a firing means (not shown) are introduced.

The diameter d of shaft 2 is smaller than the inside diameter D of housing bore 1, air gap 8 being the space between the shaft and housing. Sealing of firing channel 3 against inside wall 6 of housing G is accomplished by means of sleeves which are inserted into the shaft, the outer boundary 4 of the sleeves extending beyond the shaft. The outer boundary 4 is ground off in such a manner that an annular radial outside surface 5 is created which rests against inside wall 6, forming a very small air gap. Thus, the area where friction can occur between shaft 2 and the inside wall is substantially reduced and combustion products can flow through firing channel 3 without pressure loss.

In the foregoing specification, the invention has been described with reference to specific exemplary embodiments thereof. It will, however, be evident that various modifications and changes may be made thereunto without departing from the broader spirit and scope of the invention as set forth in the appended claim. The specification and drawing are, accordingly, to be regarded in an illustrative rather than in a restrictive sense.

What is claimed is:

1. A safety device for a firing apparatus having a housing with a circular bore having openings comprising:

shaft means rotatably supported in the circular bore, the shaft means having a smaller diameter than the diameter of the circular bore, the shaft means having a plurality of approximately curved firing channels, the channels aligning with the openings when the shaft is in the armed position, the channels having annular overextending boundaries having radially curved outside surfaces which rest against the inside wall of the circular bore.

* * * * *